United States Patent [19]

Iizuka et al.

[11] Patent Number: 4,829,764

[45] Date of Patent: May 16, 1989

[54] COMBUSTION AIR FLOW RATE ADJUSTING DEVICE FOR GAS TURBINE COMBUSTOR

[75] Inventors: Nobuyuki Iizuka; Katsukuni Hisano; Katsuo Wada; Fumiyuki Hirose; Osamu Arai, all of Hitachi, Japan

[73] Assignee: Hitachi, Ltd., Tokyo, Japan

[21] Appl. No.: 110,426

[22] Filed: Oct. 20, 1987

[51] Int. Cl.[4] ..... F02C 3/14

[52] U.S. Cl. ..... 60/39.23; 60/746; 251/294; 74/108

[58] Field of Search ..... 60/39.23, 733, 746; 251/229, 250, 294; 74/108, 89.2

[56] References Cited

U.S. PATENT DOCUMENTS

| | | | |
|---|---|---|---|
| 2,233,248 | 2/1941 | Douglas | 74/108 |
| 2,655,787 | 10/1953 | Brown | 60/39.23 |
| 2,706,913 | 4/1955 | Trossi . | |
| 3,930,368 | 1/1976 | Anderson et al. | 60/39.23 |
| 3,958,416 | 5/1976 | Hammond, Jr. et al. | 60/39.23 |
| 4,419,707 | 12/1983 | Woodier | 74/108 |
| 4,497,170 | 2/1985 | Elliott et al. | 60/39.23 |
| 4,523,737 | 6/1985 | Wentworth | 74/108 |
| 4,525,030 | 6/1985 | Montagu et al. | 74/108 |
| 4,545,196 | 10/1985 | Mongia et al. | 60/39.23 |
| 4,677,822 | 7/1987 | Iizuka et al. | 60/39.23 |

FOREIGN PATENT DOCUMENTS

| | | | |
|---|---|---|---|
| 0192266 | 8/1986 | European Pat. Off. . | |
| 222173 | 5/1987 | European Pat. Off. | 60/733 |
| 240833 | 11/1985 | Japan | 60/39.23 |
| 2065863 | 7/1981 | United Kingdom | 60/39.23 |

*Primary Examiner*—Donald E. Stout

*Attorney, Agent, or Firm*—Antonelli, Terry & Wands

[57] ABSTRACT

In a combustion air flow rate adjusting device in which a cylindrical regulating ring fitted about an outer peripheral surface of an inner cylinder of a gas turbine combustor is translated along the outer peripheral surface of the inner cylinder in order to vary an opening area of air intake ports formed in the peripheral wall of the inner cylinder, an arcuately moving part at a forward end of a lever fixedly connected to a forward end of a shaft extending inwardly through a peripheral wall of an outer cylinder of the gas turbine combustor is connected to a part reciprocating together with the regulating ring, by leaf springs.

14 Claims, 4 Drawing Sheets

COMBUSTION AIR FLOW RATE ADJUSTING DEVICE FOR GAS TURBINE COMBUSTOR

BACKGROUND OF THE INVENTION

The present invention relates to a device for adjusting flow rate of combustion air flowing into a gas turbine combustor and, more particularly, to a mechanism enabling an improvement of durability of movable parts in a combustion air flow rate adjusting device in which a cylindrical regulating ring fitted about an outer peripheral surface of an inner cylinder of a gas turbine combustor is translated axially of the inner cylinder to vary an opening area of air intake ports formed in the peripheral wall of the inner cylinder, thereby adjusting the flow rate of air passing through the air intake ports.

A premixed staged combustion system is known, as disclosed in, for example, U.S. Serial No. 917,973 filed on October 14, 1986, now Pat. No. 4,766,721, in which first stage fuel nozzles are provided for forming pilot flames at a head of a gas turbine combustor, and second stage fuel nozzles are provided at a location downstream of combustion gas for supplying premixture. Fuel is supplied to only the first stage fuel nozzles, or to both first and second stage fuel nozzles, depending upon load on the gas turbine, so that low temperature combustion is effected in the entire load range of the gas turbine.

The above-described premixed staged combustion system is advantageous in that production of nitrogen oxides (NOx) in the combustion gas is reduced because of the low temperature combustion. However, the premixed staged combustion system has such a problem that, in the course of shifting of the gas turbine load from a low load range to a high load range, when the fuel is initiated to be supplied from the second stage fuel nozzles, the second stage fuel is difficult to be completely burnt so that unburnt components such as CO, HC and the like are emitted.

Further, a gas turbine for driving a generator has the following problem. That is, the gas turbine is operated at a constant speed, regardless of load, as the generator reaches a synchronous speed. However, since the amount of fuel supplied increases substantially in proportion to the load, the mixture ratio between fuel and air varies depending upon the load. The reason for this is that air supplied to the combustor of the gas turbine is forcibly delivered by a compressor directly connected to the gas turbine rotor and, therefore, a substantially constant amount of air is given to the combustor when the rotational speed of the rotor is constant.

For the combustor in which two stage combustion is effected, it is necessary to control and regulate the fuel and air such that the ratio between them in particular at the second stage is maintained at a substantially constant proportion regardless of the load, to perform always steady combustion.

In the above-mentioned prior application Serial No. 917, 973, the control of fuel and air is effected by extraction of air to be supplied to the second stage fuel and by provision of a ring at air intake ports for regulating an opening area thereof. The extraction method is disadvantageous in that the total efficiency of the gas turbine is lowered because the extracted air is thrown away to the outside without passing through the gas turbine. The method of provision of the regulating ring at the air intake ports has no such loss that the compressed air is uselessly thrown away to the outside, but requires a mechanism for moving the ring provided adjacent an inner cylinder of the combustor. The moving mechanism for the ring is not described in detail in the above-mentioned prior application, but as a moving mechanism of such kind, a transmission mechanism is generally employed which comprises levers and links.

The transmission mechanism comprising links and levers has sliding parts around connecting pins, and wear occurs on the sliding parts. Since, in particular, the sliding parts within the gas turbine combustor are exposed to high temperature, it is difficult to supply lubricating oil to the sliding parts so that wear cannot be prevented from occurring on the sliding parts. Once the wear occurs, plays are enlarged between various components, resulting in a reduction in adjusting accuracy. This deteriorates the combustion performance.

SUMMARY OF THE INVENTION

It is an object of the invention to provide a combustion air flow rate adjusting device which comprises a moving mechanism having no sliding parts and, accordingly, having no plays so that the moving mechanism can have high durability and high adjusting accuracy maintained for a long running period of time, and can have high reliability.

In order to achieve the object, according to the invention, there is provided a combustion air flow rate adjusting device comprising a cylindrical regulating ring fitted about an outer peripheral surface of an inner cylinder of a gas turbine combustor, wherein an arcuately moving part at a forward end of a driving lever is connected, by leaf spring-like members, to a part linearly reciprocating together with the regulating ring.

With the above-described arrangement of the invention, the regulating ring is linearly reciprocated by the driving lever through the leaf spring-like members. During the reciprocating motion, the forward end of the driving lever describes an arc, and the regulating ring moves linearly. Plays between the driving lever and the regulating ring are absorbed by deflection of the leaf spring-like members. Since the arrangement has no sliding parts, there is no possibility that wear occurs, even if no lubricant is supplied.

DETAILED DESCRIPTION

Figure 1:
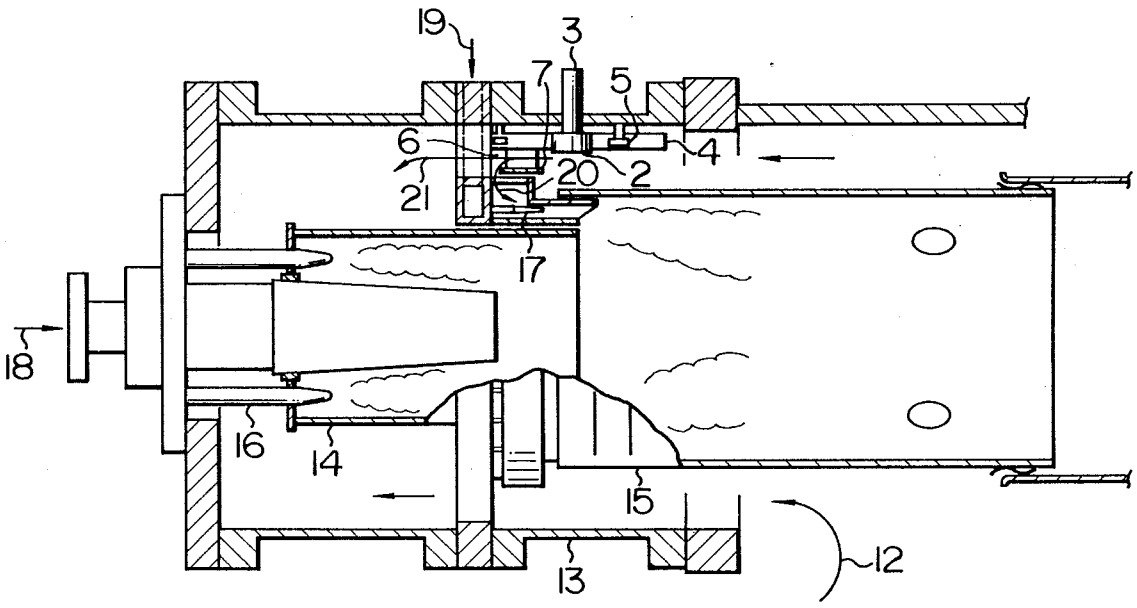
FIG. 1 is a fragmental longitudinal cross-sectional view showing a gas turbine combustor having incorporated therein a combustion air flow rate adjusting device according to an embodiment of the invention.

Referring to FIG. 1 showing an embodiment of the invention, air 12 compressed by a compressor, not shown, passes through a space in a combustor outer cylinder 13, and flows into a combustor front inner cylinder 14 and into a combustor rear inner cylinder 15.

The inflow air is mixed with fuel gas injected through front fuel nozzles 16 and rear fuel nozzles 17, and is diffused and burnt. This combustion system is called a multi-stage combustion system which has increasingly been employed positively in gas turbine combustors for high capacity gas turbine generator installations or the like, in view of the recent severe environmental regulations, for the reason that a considerably low NOx emission is achieved. In order to achieve the considerably low NOx emission, it is an important point how the combustion gas temperature is restrained to a low level and how the combustion is effected under a uniform temperature condition having no locally high temperature zones. In particular, the combustion gas temperature has close relation to a ratio between an amount of fuel and an amount of combustion air, and it is necessary for achievement of low NOx emission to control the ratio to a value within a certain constant range. Since, however, the amount of air varies depending upon the rotational speed of the gas turbine, or the amount of fuel varies depending upon the load on the gas turbine, it is difficult to control each of the amount of air and the amount of fuel. Accordingly, the control is usually effected to vary the amount of air in accordance with the amount of fuel, to thereby bring the ratio to a predetermined value.

A driving shaft 3 is provided which extends through the peripheral wall of the outer cylinder 13. A lever 2 is fixedly connected to an inner end of the shaft 3. A cylindrical regulating ring 7 for regulating air flow in a direction indicated by the arrow 20 is connected to the lever 2 by a pair of leaf springs 8 (see FIG. 2).

Figure 2:
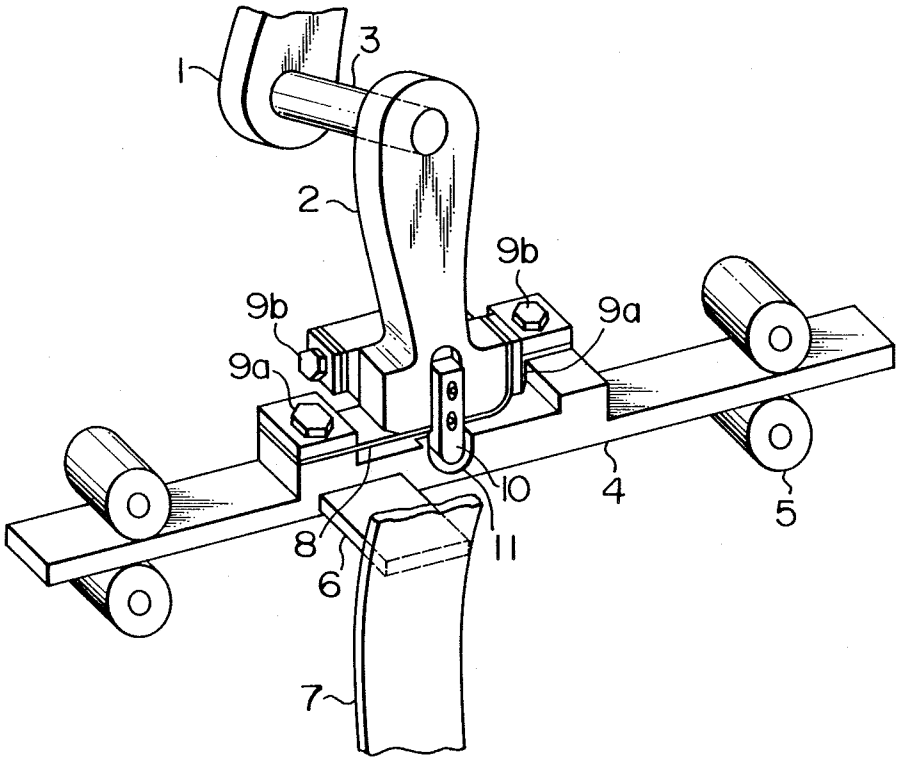
FIG. 2 is a fragmental perspective view showing the combustion air flow rate adjusting device.

As shown in FIG. 2, a mechanism for moving the regulating ring 7 comprises a driving section which is composed of an outer lever 1, the inner lever 2 and the shaft 3 connecting the levers 1 and 2 to each other. As the outer lever 1 is moved by drive means, not shown, the shaft 3 moves the inner lever 2 arcuately about an axis of the shaft 3. On the other hand, a section moving together with the regulating ring 7 is composed of a movable block 4 and the cylindrical regulating ring 7 which is supported by supports 6 fixed at a plurality of locations with respect to the movable block 4. The movable block 4 is supported by rollers 5. The inner lever 2 of the drive section and the movable block 4 of the moving section are connected to each other by the pair of leaf springs 8 to which the present invention relates. The leaf springs 8 have their respective one ends fixedly connected to the movable block 4 by mechanical means such as bolts 9*a* and 9*b* or the like. The leaf springs 8 are arranged in two in side by side relation widthwise thereof so as to permit the movable block 4 to be moved to the right and left as viewed in FIG. 1, by the arcuate motion of the inner lever 2. The details of the relationship between the inner lever 2, the leaf springs 8 and the movable block 4 will be described later. The rollers 5 clamp the movable block 4 from the opposite sides thereof to support the opposite end portions of the movable block 4 such that a constant positional relationship can be maintained between the movable block 4 and the inner lever 2. The rollers 5 serve as a guide for the movable block 4 when the same moves. An engaging pawl 10 is attached to the inner lever 2, and confronts a recess 11 provided in the movable block 4, with a gap left between the pawl 10 and the recess 11. The engaging pawl 10 is normally maintained out of contact with the recess 11, but is brought into abutting engagement with the recess 11 when abnormalities occur such as breakage of the leaf springs 8 and the like, to thereby ensure that transmission of the motion from the inner lever 2 to the movable block 4 is maintained.

The regulating ring 7 has a cylindrical shape and is located radially outwardly of the combustor rear inner cylinder 15. The regulating ring 7 can be moved axially along the outer peripheral surface of the combustor rear inner cylinder 15 by the shaft 3 supported through the combustor outer cylinder 13 and the inner lever 2 attached to the shaft 3. There are provided two driving sections for the regulating ring 7, which are arranged at diametrically opposite locations, utilizing the combustor outer cylinder 13. The position of the regulating ring 7 is retained by the rollers 5. Air 21 flowing into the front side of the combustor is also varied and controlled by the movement of the regulating lever 7.

The details of the transmission section between the inner lever 2 and the movable block 4 will be described, based on an embodiment very similar to the embodiment illustrated in FIG. 2, with reference to FIGS. 3 through 5. FIG. 4 is a cross-sectional view taken along line IV—IV in FIG. 3.

Figure 3:
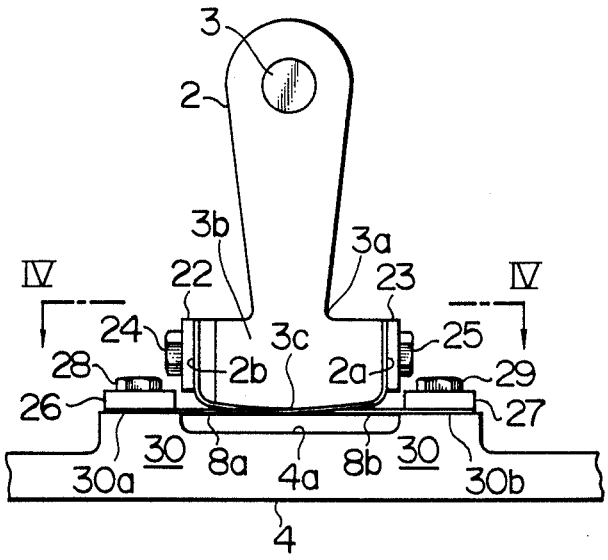
FIG. 3 is a fragmental front elevational view showing an embodiment vary similar to the embodiment illustrated in FIGS. 1 and 2.
Figure 4:
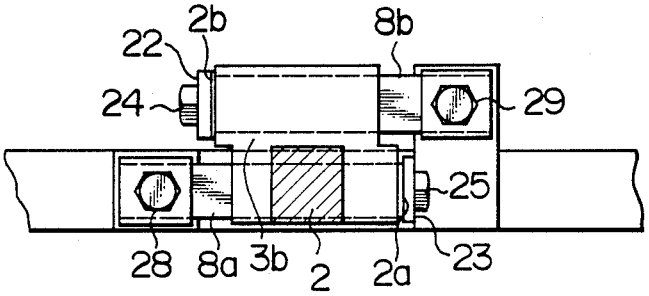
FIG. 4 is a cross-sectional view taken along line IV—IV in FIG. 3.
Figure 5:
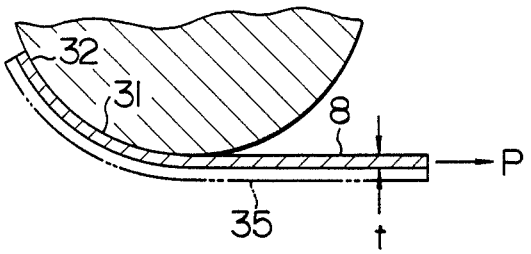
FIG. 5 is a model view for explanation of the embodiment illustrated in FIGS. 3 and 4.

As shown in FIGS. 3 and 4, a forward end portion 3*b* of the inner lever 2 has opposite side surfaces 2*a* and 2*b* at which washers 22 and 23 and bolts 24 and 25 are respectively disposed for fixing respective leaf springs 8*a* and 8*b* to the inner lever 2. One ends of the respective leaf springs 8*a* and 8*b* are clamped by the respective washers 22 and 23 in the thickness direction of the leaf springs 8*a* and 8*b*, and are urged against the respective side surfaces 2*a* and 2*b* of the inner lever 2 by the respective bolts 24 and 25. Thus, the leaf springs 8*a* and 8*b* are fixed to the inner lever 2 by the friction force and the shearing resistant force of the bolts. As clearly seen from FIG. 4, the two leaf springs 8*a* and 8*b* are arranged in side by side relation widthwise thereof. The front leaf spring 8*a* is fixed to the right side surface 2*a* of the inner lever 2, and the rear leaf spring 8*b* is fixed to the left side surface 2*b* of the inner lever 2. The configuration of the inner lever 2 is such that a portion of the inner lever 2 from an end thereof adjacent the shaft 3 to a neck 3*a* smaller in width than the shaft 3 is relatively thin in thickness, but the forward end portion 3*b*, to which the leaf springs 8*a* and 8*b* are attached, is wide in width and sufficiently thicker in thickness than the dimension of the two leaf springs 8*a* and 8*b* arranged in side by side relation widthwise thereof. The forward end portion 3*b* of the inner lever 2 has, at its foremost end, an outer surface 3*c* which is formed arcuately. That is, the outer surface 3*c* is machined into an arcuate surface (specifically, a three-dimensionally columnar surface) having a radius of curvature equal to a distance from the central axis of the shaft 3 to the outer surface 3*c* of the forward end portion 3*b*. By virtue of the arcuate surface, any locations on the outer surface 3*c* of the forward end portion 3*b* of the inner lever 2 can move always at the same distance from the shaft 3 during the arcuate movement of the inner lever 2. The other ends of the respective leaf springs 8*a* and 8*b* are fixed to the movable block 4 respectively by washers 26 and 27 and blots 28 and 29 similarly to the one ends of the respective leaf springs. The movable block 4 has its opposite end portions supported by the rollers 5 as shown in FIG. 2. The movable block 4 is formed with a recess 4*a* to avoid interference with the outer surface 3*c* of the forward end portion 3*b* of the inner lever 2, as shown in FIG. 3. Provided at the opposite sides of the recess 4*a* are a pair of seats 30 to which the washers 26 and 27 and the bolts 28 and 29 are respectively attached to fix the respective leaf springs 8*a* and 8*b*. The seats 30 are not merely projections for securing seat faces 30*a* and 30*b*, but are so set that a plane connecting both seat faces 30*a* and 30*b* to each other is in contact with the outer surface 3*c*.

In this manner, the leaf springs 8*a* and 8*b* are attached to the forward end portion 3*b* of the inner lever 2 in tangential relation or specifically in tangent plane relation. Therefore, when the forward end portion 3*b* of the inner lever 2 moves arcuately, the leaf springs 8*a* and 8*b* are always maintained horizontal, and load is applied to the leaf springs 8*a* and 8*b* only in their longitudinal direction. For this reason, only axial load is applied to the movable block 4, thereby ensuring movement of the movable block. When the inner lever 2 moves to the right, the front leaf spring 8*a* transmits the tension force to the left seat face 30*a* to move the movable block 4 to the right. During the movement of the movable block 4 to the right, the rear leaf spring 8*b* is subject to a compression force. However, when the inner lever 2 and the movable block 4 are connected to each other by the leaf springs 8*a* and 8*b*, the leaf springs are so initially set that they tend to be stretched respectively toward the left and right seat faces 30*a* and 30*b* such that a tension force is applied to both leaf springs 8*a* and 8*b*. As a consequent, the compression force is canceled with the initially set tension force, and the load becomes substantially zero so that no compression force is applied to the rear leaf spring 8*b*. On the other hand, in the vicinity of the one ends of the respective leaf springs 8*a* and 8*b* which are attached to the inner lever 2, the leaf springs 8*a* and 8*b* are bent along the radius of curvature of the machined arcuate (or specifically columnar) surface while being in contact therewith. Accordingly, bending force in addition to the tension force is more or less applied to the one end portions of the respective leaf springs 8*a* and 8*b*, unlike the other end portions of the leaf springs which are attached to the movable block 4 and which are subject only to the tension force. FIG. 5 shows the model of the relationship between the inner lever 2 and the one end portions of the respective leaf springs 8*a* and 8*b*. In FIG. 5, an arc 31 represents the arcuately machined surface of the forward end portion of the inner lever, and a thickness t on the arc 31 represents the leaf spring 8. The leaf spring 8 has one end thereof fixed to an outer periphery 32 of the arc 31, and the other end pulled by a force P moving the movable block. Stresses in the leaf spring 8 at this time include a tension stress $\sigma_t$ and a bending stress $\sigma_b$ at the arcuate portion. Let it be supposed now that the thickness of the leaf spring 8 is t, the width thereof is b, the radius of the arc is r and the Young's modulus of the spring material is E, then the tension stress $\sigma_t$ and the bending stress $\sigma_b$ are given by the following equations:

$$\sigma_t = \frac{P}{t \cdot b}, \quad \sigma_b = \frac{E \cdot t}{2r}$$

Figure 6:
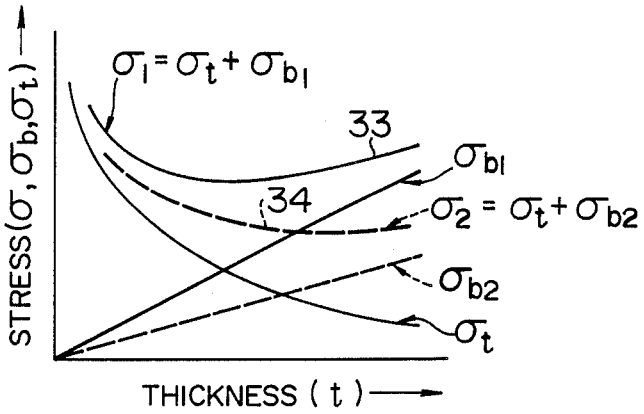
FIG. 6 is a graphical representation of characteristics of stresses in a leaf spring illustrated in FIG. 5.

When carbon steel is used as the spring material, the Young's modulus is on the order of $E_1 = 2.1 \times 10^4$ kg/mm$^2$. Supposing that the bending stress at this time is $\sigma_{b1}$, then variation in the stress following variation in the thickness t is as shown in FIG. 6, if the width b is constant. On the other hand, the tension stress $\sigma_t$ varies as shown in FIG. 6 if the width b is constant. The stress $\sigma_1$ occurring in the leaf spring becomes equal to the sum of $\sigma_t$ and $\sigma_{b1}$, and varies as indicated by the solid curve 33 in FIG. 6. It should be noted here that the solid curve 33 is convex downwardly. Thus, it is possible to provide an optimum leaf spring which is low in stress, if the thickness t is obtained which minimizes the stress $\sigma_1$. It is further to be noted that the tension stress $\sigma_t$ varies as a function of only the thickness t if the width b is constant. That is, the bending stress has relation to the thickness t and the Young's modulus E, and it is possible to restrain the bending stress to a low level by reducing the Young's modulus E. By the way, a Ti alloy or the like has its Young's modulus on the order of $1.0 \times 10^4$ kg/mm$^2$ which is a value approximately one half as compared with $2.1 \times 10^4$ kg/mm$^2$ of the carbon steel. Supposing that the bending stress at this time is $\sigma_{b2}$, then the stress occurring in the leaf spring becomes $\sigma_2$ indicated by the broken curve 34 and can considerably be reduced. Further, it is possible to utilize one or more leaf spring superposed on the leaf spring 8, as indicated by the phantom lines 35 in FIG. 5, as a way of prolonging the service life of the leaf springs. With this way, the thickness t per one leaf spring does not change and, therefore, the stress does not change, thereby enabling the service life of the leaf springs to be prolonged. As described above, the illustrated embodiments utilize the leaf springs at the connection which converts the arcuate motion to the linear motion, within the high temperature atmosphere. As a consequence, there is no possibility that wear occurs, and high reliability and durability can be exhibited even in the high temperature gas flow.

As described above in detail, according to the combustion air flow rate adjusting device of the invention, the arcuate motion can be converted to the linear motion without provision of a complicated mechanism. This enables elimination of mechanical plays, and enables the highly accurate control. Further, because of the simple mechanism, the space required for connection between the inner lever and the movable block can be saved, making it possible to facilitate the accommodation of the device. Moreover, by virtue of the use of leaf springs, sliding parts can be eliminated from the connection between the inner lever and the movable block, making it possible to improve the reliability.

What is claimed is:

1. A combustion air flow rate generating device for a gas turbine, in which a cylindrical regulating ring fitted about an outer peripheral surface of an inner cylinder of a gas turbine combustor is translated along the outer peripheral surface of the inner cylinder to vary an opening area of air intake ports formed in said inner cylinder, thereby adjusting the combustion air flow rate, wherein an arcuately moving part at a forward end of a driving lever and a part linearly reciprocating together with said regulating ring are connected to each other by oppositely directed leaf spring-like members.

2. A combustion air flow rate adjusting device as defined in claim 1, characterized in that said leaf spring-like members are arranged in at least two in side by side relation widthwise thereof such that tension force is always applied to said leaf spring-like members during the linear reciprocating motion of said regulating ring.

3. A combustion air flow rate adjusting device as defined in claim 1, characterized in that said leaf spring-like members are arranged in plural in superposed relation in a thickness direction of said leaf spring-like members.

4. A combustion air flow rate adjusting device as defined in claim 1, characterized in that a columnar surface is formed on said arcuately moving part at the forward end of said driving lever, along the arc, and portions of the respective leaf spring-like members adjacent their respective one ends are attached in contact with said columnar surface.

5. A combustion air flow rate adjusting device as defined in claim 1, characterized in that said leaf spring-like members are interposed and connected under tension between said arcuately moving part at the forward end of said driving lever and said part linearly reciprocating together with said regulating ring.

6. A combustion air flow rate adjusting device for a gas turbine, in which a cylindrical regulating ring fitted about an outer peripheral surface of an inner cylinder of a gas turbine combustor is translated along the outer peripheral surface of the inner cylinder to vary an opening area of air intake ports formed in said inner cylinder, thereby adjusting the combustion air flow rate, wherein an arcuately moving part at a forward end of a driving lever and a part linearly reciprocating together with said regulating ring are connected to each other by leaf spring-like members, said arcuately moving part at the forward end of said driving lever is provided with a first engaging portion, and said part linearly reciprocating together with said regulating ring is provided with a second engaging portion, said first and second engaging portions being brought into engagement with each other only when said leaf spring-like members are broken, and said first and second engaging portions being maintained in disengagement from each other when said leaf spring-like members function normally.

7. A combustion air flow rate adjusting device for a gas turbine combustor comprising an inner cylinder, an outer cylinder surrounding said inner cylinder, first stage fuel nozzles arranged at a front side of said inner cylinder, second stage fuel nozzles arranged adjacent an intermediate portion of said inner cylinder, and air intake ports for air to be premixed with fuel from said second fuel nozzles, said combustion air flow rate adjusting device comprising:

a regulating ring located outwardly of said air intake ports and arranged so as to surround said inner cylinder, said regulating ring being surrounded by said outer cylinder, said regulating ring being capable of being translated along an outer peripheral surface of said inner cylinder to vary an opening area of said air intake ports;

a shaft extending through a peripheral wall of said outer cylinder;

a lever located between said inner and outer cylinders and fixedly connected to said shaft; and oppositely directed leaf springs connected between a forward end of said lever and said regulating ring.

8. A combustion air flow rate adjusting device as defined in claim 7, wherein said lever has an end formed into a columnar surface, and said leaf springs have their respective one ends fixedly connected to said lever, said leaf springs extending along said columnar surface and extending tangentially thereto, the respective other ends of said leaf springs being fixedly connected to said regulating ring.

9. In a gas turbine combustor comprising an inner cylinder defining therein a combustion chamber, fuel nozzles for supplying fuel into said inner cylinder, and air intake ports through which combustion air is introduced into said inner cylinder, a combustion air flow rate adjusting device comprising regulating means for varying an opening area of said air intake ports, guide means for guiding linear reciprocating motion of said regulating means, and driving means for reciprocally driving said regulating means, said driving means including a shaft, a lever angularly moving about an axis of said shaft, and oppositely directed resilient strip-like members connecting an end of said lever and said regulating means to each other.

10. A combustion air flow rate adjusting device as defined in claim 9 for the gas turbine combustor further comprising an outer cylinder surrounding said inner cylinder, wherein said regulating means, said resilient strip-like members and said lever are arranged in a space defined between said inner and outer cylinders.

11. A combustion air flow rate adjusting device as defined in claim 9, wherein said lever has a free end formed to have a columnar surface, and said resilient strip-like members have their respective one ends fixedly connected to said free end of said lever, said resilient strip-like members extending along said columnar surface and extending tangentially thereto, the respective other ends of said resilient strip-like members being fixedly connected to said regulating means.

12. A combustion air flow rate adjusting device as defined in claim 9, wherein said air intake ports are arranged in plural circumferentially of a wall surface of said inner cylinder, and said regulating member is in the form of a ring fitted about an outer peripheral surface of said inner cylinder.

13. A combustion air flow rate adjusting device for a gas turbine, comprising an inner cylinder, an outer cylinder surrounding said inner cylinder, first stage fuel nozzles arranged at a front side of said inner cylinder, second stage fuel nozzles arranged adjacent an intermediate portion of said inner cylinder, and air intake ports for air to be premixed with fuel from said second fuel nozzles, said combustion air flow rate adjusting device comprising:

a regulating ring located outwardly of said air intake ports and arranged so as to surround said inner cylinder, said regulating ring being surrounded by said outer cylinder, said regulating ring being capable of being translated along an outer peripheral surface of said inner cylinder to vary an opening area of said air intake ports;

a shaft extending through a peripheral wall of said outer cylinder;

a lever located between said inner and outer cylinders and fixedly connected to said shaft, the forward end portion of the lever has a three-dimensionally columnar surface having a radius of curvature equal to a distance from the central axis of the shaft to the outer surface of the forward end portion; and leaf springs connected between a forward end of said lever and said regulating ring, said leaf springs having their respective one ends fixedly connected to said lever, said leaf springs extending along said columnar surface and extending tangentially thereto, the respective other ends of said leaf springs being fixedly connected to said regulating ring.

14. A combustion air flow rate adjusting device according to claim 13, wherein the leaf springs are oppositely directed at the forward end of said lever.

* * * * *